United States Patent [19]

Pressell

[11] Patent Number: 4,461,131

[45] Date of Patent: Jul. 24, 1984

[54] PANEL INTERCONNECTION SYSTEM

[75] Inventor: Mark A. Pressell, Cadillac, Mich.

[73] Assignee: AAR Corporation, Del.

[21] Appl. No.: 380,623

[22] Filed: May 21, 1982

[51] Int. Cl.[3] ..... E04F 15/14

[52] U.S. Cl. ..... 52/395; 52/465; 52/580; 52/403

[58] Field of Search ..... 52/586, 582, 280, 281, 52/396, 465, 578, 471, 580, 581, 395, 403, 573; 403/174, 178, 217, 294; 404/68, 65

[56] References Cited

U.S. PATENT DOCUMENTS

| | | | |
|---|---|---|---|
| 2,844,848 | 7/1958 | Couse et al. | 52/280 |
| 2,866,235 | 12/1958 | Couse et al. | 52/586 |
| 2,882,564 | 4/1959 | Couse et al. | 52/465 |
| 3,348,459 | 10/1967 | Harvey | 52/586 |
| 3,363,383 | 1/1968 | La Barge | 52/573 |
| 3,572,224 | 3/1971 | Perry | 52/586 |
| 3,974,614 | 8/1976 | Strong | 52/396 |

*Primary Examiner*—James L. Ridgill, Jr.
*Attorney, Agent, or Firm*—Barnes, Kisselle, Raisch, Choate, Whittemore & Hulbert

[57] ABSTRACT

An assembly or panels of rectangular shape, as for example, a floor, in which the panels comprise upper and lower rigid sheets separated by a core, elongated fittings extending along adjacent edges of adjacent panels and having lateral extensions received between edge portions of the sheets of the panels. Each fitting has an upwardly open channel located beyond the edge of the associated panel. Adjacent fittings, and hence adjacent panels are secured together by elongated connector strips which have parallel elongated lugs received in the channels of the adjacent fittings.

22 Claims, 3 Drawing Figures

PANEL INTERCONNECTION SYSTEM

BRIEF SUMMARY OF THE INVENTION

The present invention relates to an assembly of panels into an interconnected, generally co-planar relationship by an interconnection system which provides for repeated assembly and disassembly of the panels. A typical use of the assembly is in providing flooring. The panels are ordinarily rectangular, and each comprises upper and lower substantially rigid sheets and an interposed core of a displaceable material, such as a honeycomb of light sheet material.

A connector system is provided which allows limited differential panel movement, while maintaining interpanel alignment, provides a seal against water and dirt, and which is designed to permit repeated assembly and disassembly of the panels. The connector system is made up of fittings which extend along the edges of the panels and are secured thereto by lateral extensions which extend into the edges of the panels between the upper and lower sheets, and which comprise spaced upper and lower horizontal flanges which are received between the inner surface of the edge portions of the panel sheets and the core material, and which in turn receive the adjacent edge portion of the panel core therebetween.

The fittings include a vertical wall from which the flanges extend, and which closes the opening between the panel sheets at the edge of the panel. The fittings are shaped to provide continuous upwardly open channels at the sides of the panels, the vertical fitting wall forming one side wall thereof. The channel comprises a bottom wall and an outer side wall. Adjacent the top edges of the channel side walls there is provided continuous inwardly projecting locking ribs which confront each other.

The connector system includes elongated connecting and sealing strips, each of which has a pair of downwardly extending continuous lugs adapted to be received in the parallel upwardly open channels of adjacent fittings. The lugs have lateral enlargements between their upper and lower edges, forming outwardly facing grooves between the lateral enlargements and the body of the strip, for receiving the ribs in the channels.

The connector strips are formed of slightly yieldable material, such as a rubber having a hardness of about 65–70 Durometer. The strips have slight lateral flexibility to permit limited relative tilting between adjacent panels. In addition the strips are longitudinally flexible to provide for progressive engagement and disengagement with respect to the rigid fittings, and provide for multiple assembly and disassembly operations.

DETAILED DESCRIPTION

Figure 1:
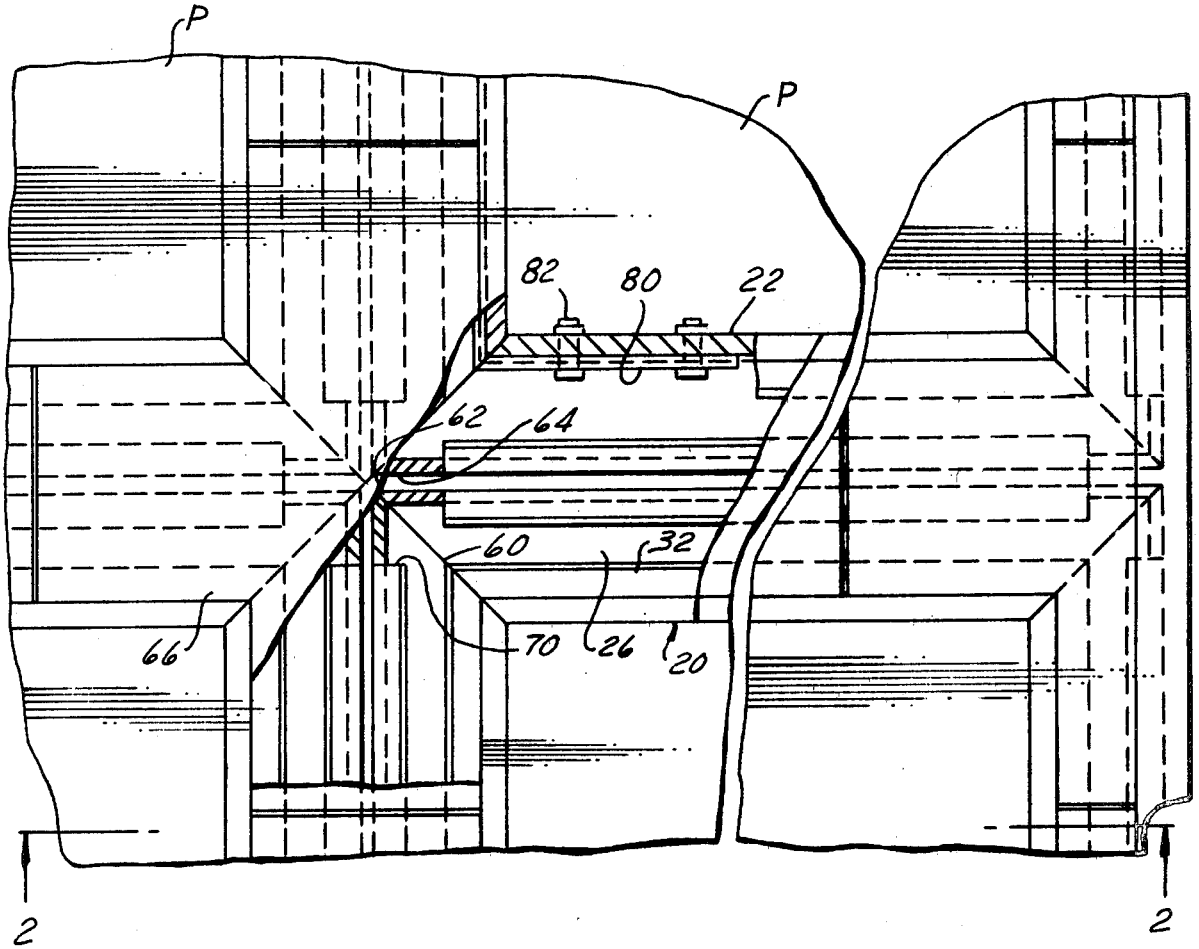
FIG. 1 is a fragmentary plan view showing a corner of interconnected panels.

Referring now to the drawings, there is illustrated a floor construction of an assembly of a multiplicity of panels P, which are preferably rectangular.

Figure 3:
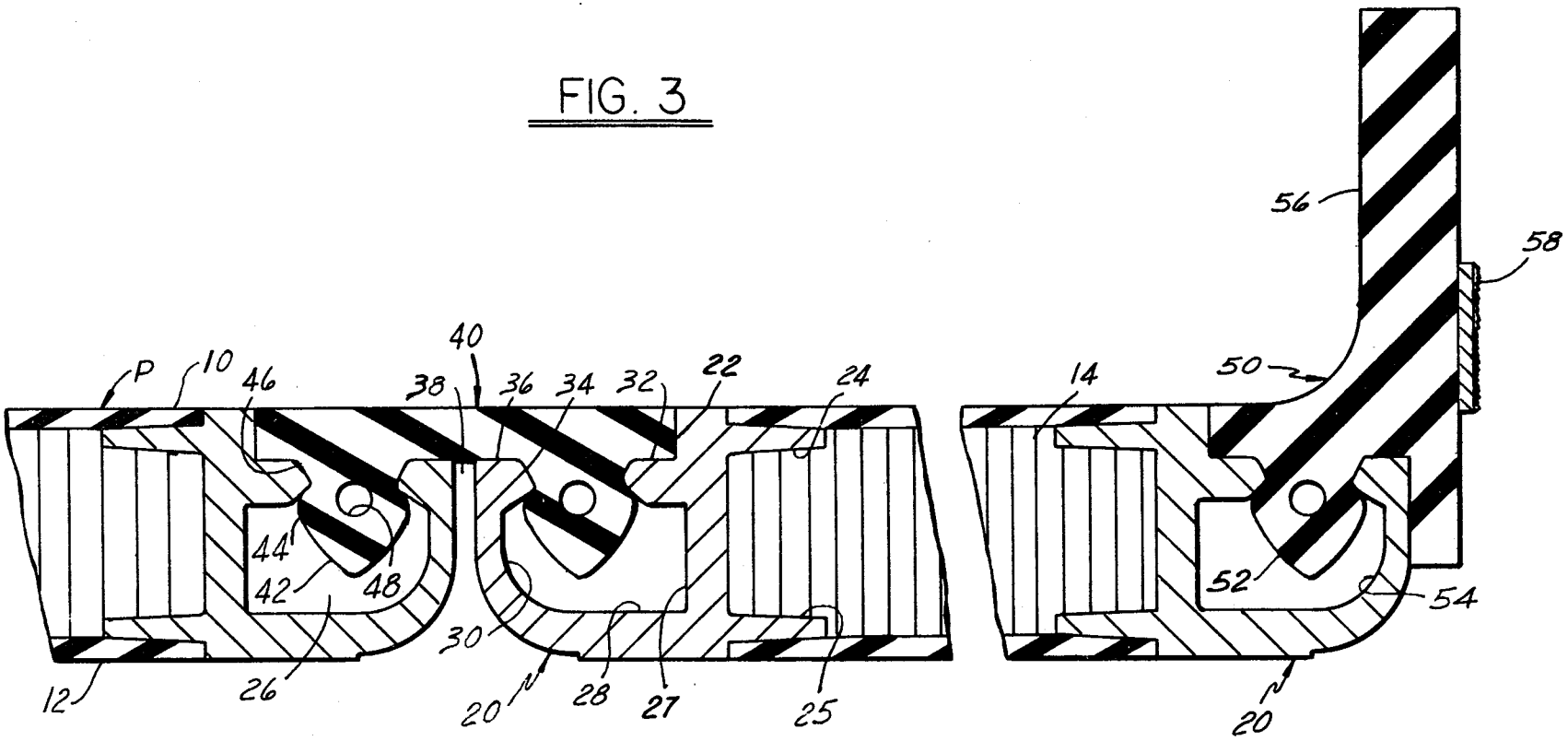
FIG. 3 is an enlarged sectional view, including a detail of the edge construction.

Each panel, as best seen in FIG. 3, comprises upper and lower rigid sheets 10 and 12, which may be high density fiber reinforced plastic such as epoxy, the upper sheet being provided with a textured non-skid coating. The upper and lower sheets are spaced apart by a fiber honeycomb core 14 which is strong, water resistant, and lightweight. The upper and lower sheets 10 and 12 of each panel are bonded to the adjacent surfaces of the core 14, the edges of the core and sheets being free of bonding material to provide for attachment of fitting for connecting adjacent panels together.

The panels are connected together with four corners of adjacent panels being slightly spaced as seen in FIG. 1, by fittings 20 which are preferably light metal extrusions, such as aluminum.

Each fitting 20 is elongated and continuous and extends the full length of the associated panel edge, and slightly beyond the ends of the edge to provide for interfitting beveled ends as will be described. In cross-section, each fitting comprises a vertical wall 22 which is dimensioned to close the space between the upper sheet 10 and the lower sheet 12. Vertical wall 22 is provided with a lateral extension formed by upper and lower spaced apart horizontal flanges 24 and 25 respectively. These flanges are spaced inwardly from the upper and lower edges of vertical wall 22 by the thickness of sheets 10 and 12, so that when the flanges are inserted between the edge portions of the sheets and the core 14 the outer surfaces of the sheets are co-planar with the edge surfaces of vertical wall 22. The flanges are preferably slightly tapered to facilitate insertion. The fittings are bonded to the panels by a suitable adhesive such as a high strength epoxy adhesive.

Each fitting is shaped in cross-section to provide a continuous upwardly open channel 26 which is defined by the lower portion 27 of vertical wall 22, bottom wall 28 and outer wall 30. The vertical fitting wall 22 is provided with an outwardly extending elongated continuous locking rib 32 which is spaced below the top edge of wall 22 to accommodate a sealing and connector strip as will subsequently be described. The free edge of rib 32 is beveled as shown. The outer wall 30 of the channel is provided at its upper edge with an inwardly extending elongated continuous locking rib 34 which confronts rib 32 and leaves a restricted space therebetween. The upper edge 36 of outer channel wall 30 is co-planar with the upper surface of rib 32.

From the foregoing, it will be apparent that the edge of a sub-assembly comprising a panel P and its edge fittings 20 is the outer surface of outer channel wall 30. As is clearly shown in FIG. 3, the edges of the sub-assemblies are spaced apart as indicated at 38.

The adjacent panels are connected together to form a floor by connector and sealing strips 40, which are preferably extrusions of natural or synthetic rubber or equivalent plastic material having a hardness of about 65–70 Durometer. The strips are each provided with two elongated continuous parallel lugs 42 which include laterally extending lobes 44 providing grooves 46 which receive the edges of ribs 32 and 34. It will be understood that the material of the strips is slightly compressible or distortable. The strip at the same time has sufficient longitudinal flexibility to permit progressive insertion of the lugs 42 to press the lobes 44 beyond the confronting edges of the ribs 32, 34. The lugs 42 are preferably provided with continuous longitudinally extending openings 48 generally in the area of the lobes 44, which facilitates insertion and removal of the strips into and out of the connecting and sealing relationship illustrated.

In addition to slight longitudinal flexibility, the strips 40 have limited lateral flexibility which provides for limited differential movement between adjacent interconnected panels.

It will be observed that the strip 40 is dimensioned such that when the assembly is complete, the strips, the upper sheets 10, and the upper surfaces of fitting wall 22 are all co-planar, thus defining a smooth continuous floor surface.

FIG. 3 also shows the manner in which an edge of the assembly of panels is finished. The out edges of the panels at the border of the assembly are closed by a fitting 20 identical with those used to connect edges of adjacent panels. In this case however a special edge strip 50 is provided which includes a single lug here designated 52 which is received as before in the fixture channel 54. The strip has an upstanding flange 56 to which the lower edge of a fabric enclosure may be detachably secured, as by grommets or a Velcro strip 58.

Referring again to FIGS. 1 and 2, it will be seen that the ends of the fittings 20 are beveled as seen at 60 so that the end surface of the fitting extends at 45° to the length of the fitting. The adjacent extending ends of the fittings at the corner of a single panel abut as shown to form a 90° included angle corner as seen at 62. This results in an assembly such that a cross-shaped opening 64 is provided which may be covered and enclosed by a single cross connector and seal 66. Connector 66 has four arms each of which is provided with two parallel lugs 68 which are received in the end portion of channels 26. The ribs 34 of the fittings 20 terminate short of the beveled end of the fitting, as seen at 70.

Accordingly, a single cross-shaped connector and seal 66 interconnects four adjacent panel corners and provides a continuous seal overlying the spaces between adjacent fittings. This arrangement is particularly useful since it provided for initial panel alignment at the corners of the four adjacent panels and the elongated straight connector and sealing strips may be applied after all of the panels which make up a single assembly are aligned in proper order and connected by the cross-shaped connectors.

Figure 2:
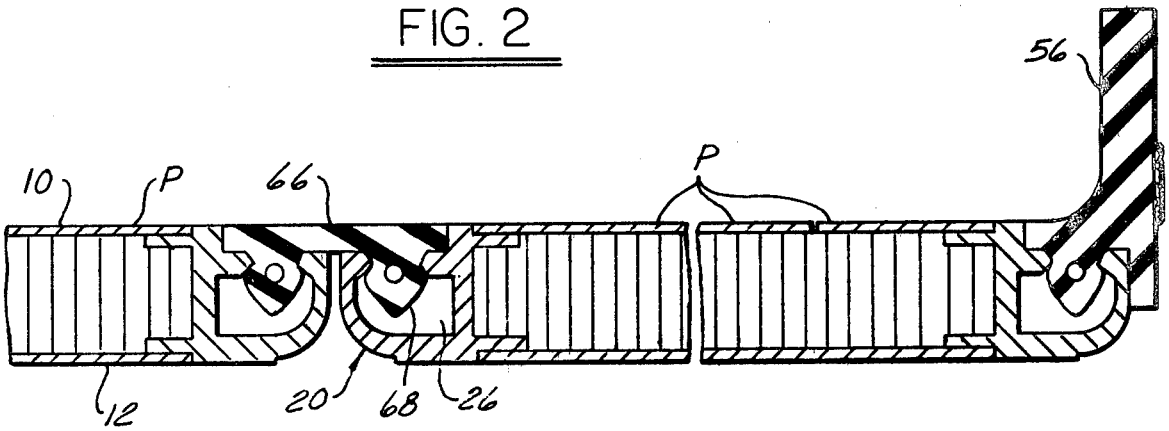
FIG. 2 is a fragmentary section on the line 2—2, FIG. 1.

Corner reinforcing strips 80 may be riveted to end portions of fitting wall 22 by rivets 82 as seen in FIG. 2, and provide permanent attachment of the fittings 20 to the associated panel P.

I claim:

1. A floor construction comprising an assembly of rectangular panels having spaced upper and lower sheets of substantial thickness, means connecting and sealing adjacent edges of panels comprising individual rigid fittings for attachment to the adjacent edges of adjacent panels, and connector and sealing strips connecting adjacent fittings, each fitting comprising an inner vertical wall having a height equal to the thickness of the panels, and upper and lower flanges extending laterally from one side of said fitting into the space between edge portions of said sheets, said flanges being spaced vertically from the top and bottom edges of said wall by the thickness of said sheets to cause the outer surfaces of said sheets to be co-planar with the upper and lower edges of said wall, said fitting having an upwardly open channel at the outer side of said inner wall, the outer wall of said channel having its upper edge spaced below the plane of said floor, longitudinally and inwardly extending confronting locking ribs on said walls, the upper surface on the locking rib on said inner wall being co-planar with the upper edge of said outer wall, said sealing and connecting strip having a thickness equal to the spacing of the upper surface of the rib on said inner wall and the upper edge of said outer wall to cause said strip to have its upper surface co-planar with the floor, said strip having spaced parallel downwardly extending lugs received in the channels of adjacent fittings, said lugs having laterally and longitudinally extending lobes defining grooves in which said ribs are received, said strip being formed of a yieldable resilient material to provide for pressing said lugs downwardly into said channel.

2. A floor construction comprising an assembly of rigid, rectangular panel units assembled together with adjacent edges thereof flexibly interconnected and sealed by connector strips of limited flexibility and yieldability, each panel unit provided along an edge thereof adjacent another unit with a channel defined by an inner wall extending to the top of said unit having its upper edge co-planar with the upper surface of said unit, a bottom wall, and an outer wall having its upper edge below the plane of the upper surface of said unit, said inner wall having a first locking rib extending into said channel and spaced below the top of said inner wall to be co-planar with the top surface of said outer wall, a spaced locking rib at the top of said outer wall extending into said channel and confronting said first rib, the upper surfaces of said ribs being flat and co-planar, the outer walls at the adjacent edges of a pair of said units being slightly spaced apart, an elongated sealing and connector strip for connecting the edge portions of adjacent units, said strip being formed of a hard plastic material having limited flexibility and compressibility, said strip having a flat upper surface co-planar with the upper surfaces of said units and a lower surface supported by the four co-planar upper surfaces of the locking ribs on the adjacent channels, said strip having downwardly extending lugs spaced inwardly from the edges of said strip and spaced apart to enter the channels of said pair of units when said units are spaced slightly apart, said lugs having laterally enlarged lobes defining grooves at opposite sides of each lobe receiving the adjacent locking ribs, in which the limited compressibility of the material of the strips provides for progressive downward insertion of the lugs into the channels of adjacent panel units.

3. The construction as defined in claim 2, in which said assembly of panel units includes inner units defining with adjacent units four adjacent corner portions, separable cross-shaped connectors including four short arms having cross-section identical with the cross-section of the strips and lugs of said sealing and connector strips, the lugs of said cross-shaped connectors being insertable into the channels at the four adjacent corners of four panel units to provide preliminary location and connection of such units in assembling a floor.

4. The fixture for use in assembling a plurality of horizontal panels formed of parallel substantially rigid upper and lower sheets having a displacable core therebetween, said fixture being elongated and rigid and having an inner vertical wall, a lateral extension at one side of said wall for insertion between the edge portions of the sheets of a panel, and an elongated channel at the other side of said wall for receiving an elongated lug on a connector strip, said channel being formed at its inner side by said vertical wall, a channel bottom wall and an outer vertical wall, said inner and outer walls having opposed locking ribs, the locking rib on said inner wall being spaced below the upper edge of said inner wall, the upper edge of said outer wall being below the horizontal plane containing the upper edge of said inner wall, the upper surfaces of said ribs and the vertical surface of said inner wall above the rib carried thereby constituting recessed seats for a sealing and connecting strip to provide a flat continuous floor surface when assembled.

5. An assembly comprising a pair of horizontal panels each having opposite sides defined by parallel substantially rigid spaced sheets, means interconnecting the sheets of each panel to provide a space therebetween, the panels of each pair have spaced apart, parallel, adjacent edges, means interconnecting the adjacent edges of said pair of panels while providing a seal, permitting limited differential movement, maintaining the panels in substantially co-planar relationship, and providing for repeated assembly and disassembly of the assembly, said interconnecting means comprising a pair of identical elongated rigid fittings, each having an elongated lateral extension inserted between the edge portions of said sheets at the said adjacent edge of one of said panels, each of said fittings having an elongated upwardly open channel located laterally beyond the adjacent edge of the panel to which it is directly connected, the channels opening toward the upper sides of the pair of panels thereby providing a pair of elongated parallel upwardly opening channels, and an elongated connector strip having a pair of parallel elongated downwardly extending locking lugs each received in one of said channels, the channel of each of said fittings having inwardly directed opposed locking ribs adjacent the open top of said channel, each of said lugs having longitudinally extending lateral enlargements at opposite sides intermediate its ends defining a pair of opposed grooves in which said ribs are detachably received, said connector strips being formed of a slightly yieldable resilient material to permit directly said lugs to be pressed into said grooves, the rib at the inner side wall of each channel being located downwardly from the upper edge of the adjacent side wall of the channel and the outer side wall of each channel having its upper edge spaced below the upper edge of said inner side wall to provide a seat for the strip, said strip having a thickness substantially equal to the spacing of the locking ribs below the upper surface of the associated panel.

6. An assembly as provided in claim 5, said strips having limited transverse flexibility to provide for limited relative movement between said panels out of strict co-planar relationship.

7. An assembly as provided in claim 5, said strips having limited longitudinal flexibility to provide for progressive insertion and removal of the lugs thereon with respect to the associated fixture channel.

8. An assembly as provided in claim 5, in which the ends of fittings which are located at interior panel corners of the assembly extend beyond the edge of the panel adjacent to the edge at which said fitting is provided, said extensions being beveled across the end to cause the beveled fitting corners to be closely spaced.

9. An assembly as provided in claim 8, comprising interior cross-shaped connector and seal elements having four arms, each of which has two depending lugs receivable in the end portions of the parallel channels provided in the fittings of adjacent panels.

10. An assembly as provided in claim 9, in which the cross-shaped connector and seal elements comprise continuous cross-shaped seal portions covering the space provided between the adjacent ends of the fittings on the four adjacent panels.

11. An assembly as provided in claim 5, the lugs on said connector strip being spaced apart by a dimension such that the outer channel walls on the fittings interconnected thereby are spaced apart.

12. An assembly as provided in claim 11, said strips having limited transverse flexibility to provide for limited relative movement between said panels out of strict co-planar relationship.

13. An assembly as provided in claim 5, in which the means connecting the sheets of each panel is a honeycomb core construction.

14. An assembly as provided in claim 13, in which the sheets of each panel are adhered to its core, the lateral extensions of each of fittings comprising a pair of spaced flanges inserted between the sheets and core of the panel to which said fitting is attached, and receiving the edge portion of the core therebetween.

15. An assembly as provided in claim 14, each of said flanges being continuous and extending the full length of the side of the panel to which said fitting is attached.

16. An assembly as provided in claim 15, the outer surfaces of said flanges being bonded to the inner edge surfaces of the sheets of the panel to which said fitting is attached.

17. An assembly as provided in claim 5, the channel of each of said fittings having inwardly directed opposed locking ribs adjacent the open top of said channel.

18. An assembly as provided in claim 17, the rib at the side of said channel adjacent the associated panel being located inwardly from the outer edge of the side wall of the channel and the rib at the other side of said channel being directly opposed from the first mentioned rib to thereby provide a seat for one edge of said connecting and sealing strip.

19. An assembly as provided in claim 18, said strip having a thickness dimension which positions its outer surface substantially co-planar with the outer surface of the panel to which said fitting is connected.

20. An assembly as provided in claim 17, each of said lugs having longitudinally extending lateral enlargements at opposite sides intermediate its inner and outer edges defining a pair of opposed grooves in which said ribs are detachably received.

21. An assembly as provided in claim 20, said connector strip being formed of slightly yieldable material to permit said lugs to be pressed into said grooves.

22. An assembly as provided in claim 21, said lugs having a continuous opening extending longitudinally thereof adjacent and between the lateral enlargements thereof.

* * * * *